US008002202B2

(12) United States Patent
Ginelli et al.

(10) Patent No.: US 8,002,202 B2
(45) Date of Patent: Aug. 23, 2011

(54) AIR BRUSH MARKER

(75) Inventors: Richard Ginelli, Oakland, NJ (US); Jonathan Jaget, Montclair, NJ (US)

(73) Assignee: MEGA Brands International, Luxembourg, Zug Branch (CH)

( * ) Notice: Subject to any disclaimer, the term of this patent is extended or adjusted under 35 U.S.C. 154(b) by 288 days.

(21) Appl. No.: 12/244,477

(22) Filed: Oct. 2, 2008
(Under 37 CFR 1.47)

(65) Prior Publication Data

US 2009/0134236 A1 May 28, 2009

Related U.S. Application Data

(60) Provisional application No. 60/977,562, filed on Oct. 4, 2007.

(51) Int. Cl.
*B05B 9/00* (2006.01)

(52) U.S. Cl. ..... 239/326; 239/330; 239/355

(58) Field of Classification Search ..... 239/326, 239/329, 330, 355, 356–363, 269, 370, 371, 239/369
See application file for complete search history.

(56) References Cited

U.S. PATENT DOCUMENTS

| | | | |
|---|---|---|---|
| 2,348,420 | A | 5/1944 | Rose |
| 2,354,063 | A | 7/1944 | Rose |
| 5,156,684 | A | 10/1992 | Mayer et al. |
| 5,190,220 | A | 3/1993 | Bolton |
| 5,687,886 | A | 11/1997 | Bolton |
| 6,024,300 | A | 2/2000 | Bolton |
| 6,270,021 | B1 | 8/2001 | Bolton |
| 6,283,388 | B1 | 9/2001 | Bolton |
| 2003/0090011 | A1 | 5/2003 | Bolton |
| 2004/0079817 | A1 | 4/2004 | Chang |

FOREIGN PATENT DOCUMENTS

| | | | |
|---|---|---|---|
| JP | 61 042350 | A | 2/1986 |

OTHER PUBLICATIONS

International Preliminary Report on Patentability and Written Opinion mailed Apr. 15, 2010 in PCT/IB2008/002622.

International Search Report and Written Opinion dated Feb. 24, 2009.

*Primary Examiner* — Christopher S Kim

(74) *Attorney, Agent, or Firm* — Plumsea Law Group, LLC

(57) ABSTRACT

An air brush marker includes a marker barrel having a first end and a second end, with a pump disposed at the first end of the marker barrel and a hollow nib disposed at the second end that is configured to absorb ink. A filter is disposed within the marker barrel, is configured to absorb ink and is positioned in contact with the nib. A tube is disposed within the marker barrel and provides an air passage extending from the pump to the nib. The pump is configured to supply a burst of air through the tube and the nib such that ink particles are sprayed out of the marker at the second end in a generally dispersed pattern.

20 Claims, 21 Drawing Sheets

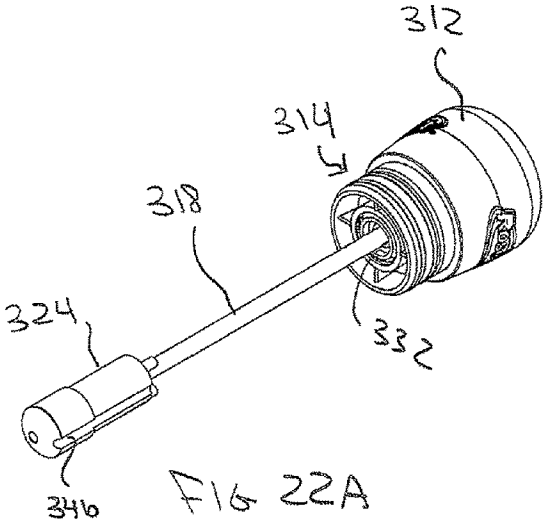
FIG 22A
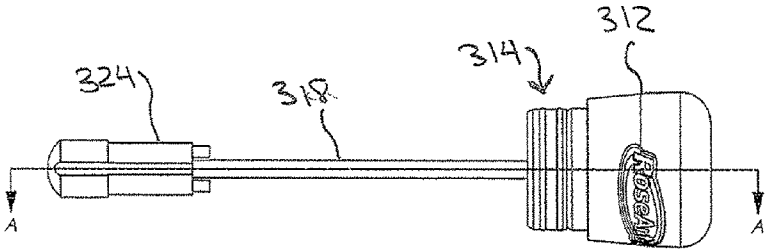
FIG 22B
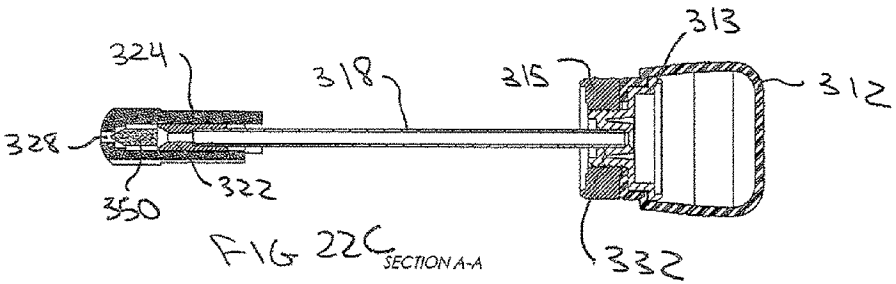
FIG 22C SECTION A-A

AIR BRUSH MARKER

This application claims the benefit of U.S. Provisional Application No. 60/977,562, filed Oct. 4, 2007, which is herein incorporated by reference in its entirety.

BACKGROUND

1. Field of the Invention

The present invention relates generally to writing instruments and, more particularly, to a single writing instrument that can function as a marker and also dispense ink in a spray to provide an air brush effect. An embodiment of an air brush marker includes a nib that extends outwardly of the marker barrel and that defines an internal air passageway leading to an orifice or hole at the end of the nib.

2. Background of the Invention

Artists, whether adults or children, enjoy creating artwork using a variety of media and application techniques. For example, a drawing or painting can be more interesting if it incorporates different line thicknesses and shapes (e.g., single lines and cross-hatching), different textures (e.g., brush strokes and stippling), and different visual effects (e.g., transparent washes and air brushing). To achieve these different effects, users often must switch between multiple writing and art instruments. In addition, the instruments can be difficult to use for children and beginner artists. Therefore, there is a continual need for simple writing and art instruments that enable a user to conveniently apply media such as ink or paint in different ways to achieve different visual effects.

BRIEF SUMMARY OF THE INVENTION

An embodiment of the present invention provides an air brush marker comprising a barrel and a nib extending from the barrel, the nib defining an internal air passageway that leads to an orifice or hole at the end of the nib.

According to another aspect of the present invention, an air brush marker is provided that includes a marker barrel having a first end and a second end, with a pump disposed at the first end of the marker barrel and a hollow nib disposed at the second end that is configured to absorb ink. A filter is disposed within the marker barrel, is configured to absorb ink and is positioned in contact with the nib. A tube is disposed within the marker barrel and provides an air passage extending from the pump to the nib. The pump is configured to supply a burst of air through the tube and the nib such that ink particles are sprayed out of the marker at the second end in a generally dispersed pattern.

According to another aspect of the present invention, an air brush marker is provided that includes a barrel and a filter disposed within the barrel for storing a liquid reservoir. A hollow nib is provided for absorbing liquid, is in fluid communication with the filter, extends outwardly from a first end of the barrel, and has an opening at a tip portion. An air passage extends from a second end of the barrel, past the first end of the barrel, and to the opening at the tip portion of the nib. A burst of air passing through the air passage causes liquid to be dispensed out of the tip portion of the nib in a generally dispersed pattern.

According to another aspect of the present invention a method is provided for dispensing ink onto a surface in a generally dispersed pattern. The method includes providing a marker that includes a barrel, a pump disposed at a first end of the barrel, a filter for absorbing liquid disposed within the barrel, a tube disposed within the barrel, and a hollow nib disposed at a second end of the barrel. The hollow nib is saturated with ink and a diffuser is positioned within the hollow nib. The diffuser is configured to position the tube within the marker. A secondary diffuser is positioned within the nib and has a conical surface proximal to an opening in the nib. The pump is compressed to cause a burst of air to be supplied through the tube, through a central region of the nib, through the diffuser, and around the secondary diffuser. Liquid particles are dispensed through an opening in the nib onto a surface in a generally dispersed pattern.

BRIEF DESCRIPTION OF THE DRAWINGS

FIGS. 22A-22C are schematic diagrams of a partial marker assembly in accordance with an embodiment of the present invention.

DETAILED DESCRIPTION OF THE INVENTION

Figures 1, 2, 3:
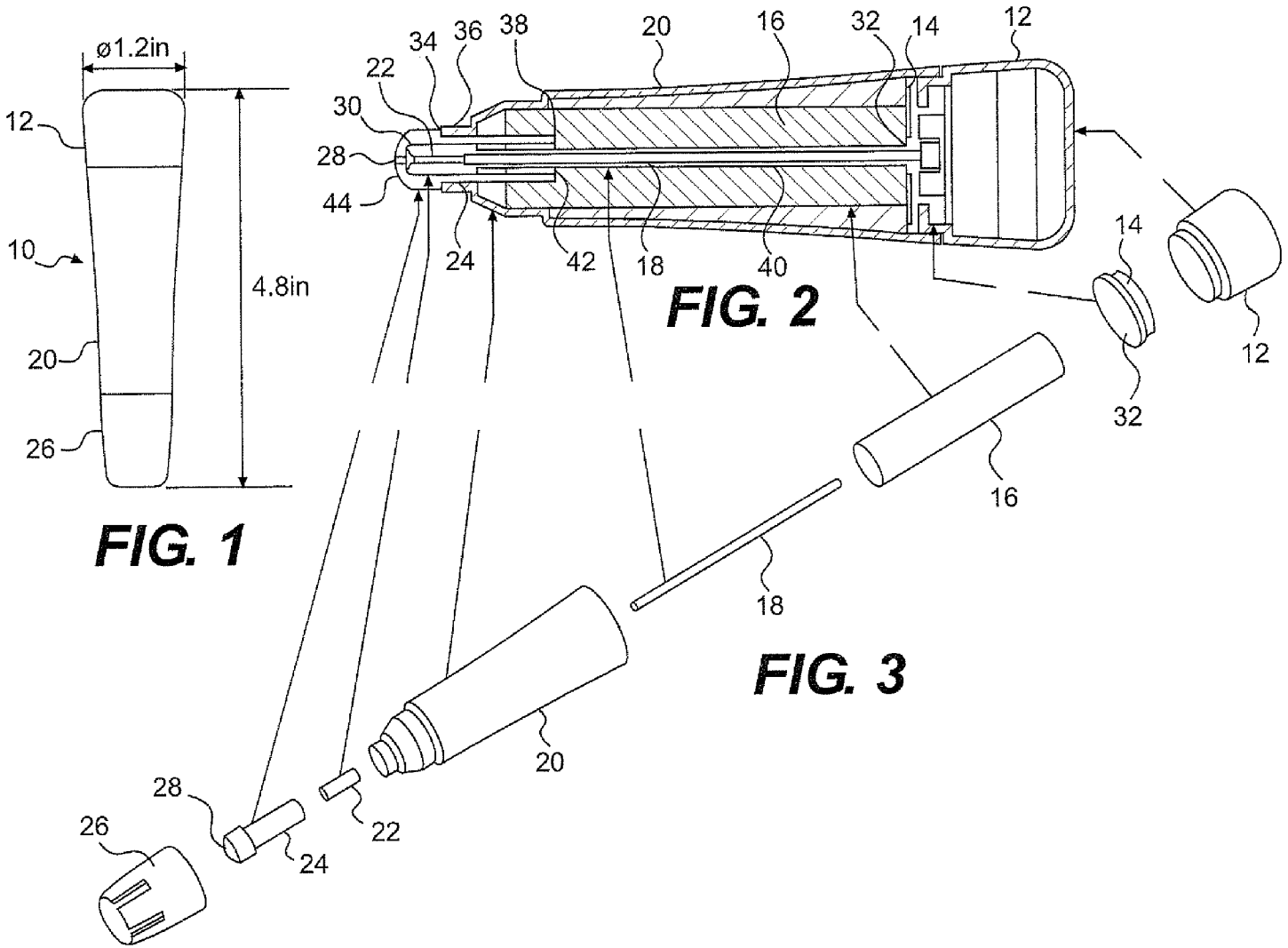
FIG. 1 is a schematic diagram of an air brush marker in accordance with an embodiment of the present invention.
FIG. 2 is a schematic cross-sectional view of an air brush marker in accordance with an embodiment of the present invention.
FIG. 3 is an exploded view of an air brush marker in accordance with an embodiment of the present invention.

In accordance with an embodiment of the present invention, an air brush marker 10 is provided as shown in FIGS. 1-3. The marker 10 generally includes a barrel 20 with a nib 24 at a first end of the barrel 20 and a pump 12 at a second end of the barrel 20. An absorbent filter 16 is disposed within the barrel 20 and in contact with the nib 24. The filter 16 is saturated with ink which, in turn, saturates the nib 24 by capillary action. A cap 26 may be removably attachable to the first end of the barrel 20 to prevent drying out of the ink in the nib 24.

In a first mode of operation, the above-described elements may be used in the marker 10 as a conventional marker, highlighter, or pen. Accordingly, a user may grip the barrel 20 as any other writing implement and place the nib 24 against a surface in order to transfer the ink in the nib to the surface.

In a second mode of operation, the marker 10 is used as an air brush. To enable this second mode of operation, the marker 10 further includes a plug 14 for use in connection with the pump 12, a tube 18, and a diffuser or tube guide 22. The pump 12 can be a bulb pump or bellows-type pump, and can be made of rubber, an elastomer, or other suitable material. The pump 12 may be glued or otherwise attached to the plug 14 (such as by interference fit), which is attached to an end of the barrel 20. The plug 14 has a centrally disposed hole 32 in order to establish an air passage from the interior of the pump 12 to the tube 18, which is inserted into the hole 32. The tube 18 may be inserted into the plug 14 by any known means, such as by threads, glue, or snap-fit.

The nib 24 is inserted into an end of the barrel 20 opposite to pump 12. The nib 24 may be provided with an annular shoulder 34 that abuts an end surface 36 of the barrel 20 to establish the position of the nib 24 within the barrel 20. An internal end 38 of the nib 24 can be inserted into the filter 16 in order to be in contact therewith and fill the nib 24 with ink. The whole nib 24 preferably becomes saturated with ink from the filter 16 by capillary action. The nib 24 has an opening 28 in its end to allow for the passage of air. The nib 24 may be made of a fiber-based or foam material, or it may be formed of 40-density molded polyethylene.

The tube 18 extends from the hole 32 in the plug 14, through a central bore 40 in the filter 16, and past the internal end 38 of the nib 24 so that it ends within the cavity 42 formed by the nib 24. A diffuser or tube guide 22 is disposed within the nib cavity 42 and around the diameter of the tube 18 to receive and centrally locate the tube 18 in the nib 24. The guide 22 is generally tubular, with an outer diameter approximately equal to the inner diameter of the nib 24, and an inner diameter that is slightly smaller than the outer diameter of the tube 18. As such, the guide 22 rests within the nib 24 such that one end abuts an internal end surface 44 of the nib 24 and the other end is stretched over the end of the tube 18. The end of the guide 22 abutting the internal surface 44 of the nib 24 may be provided with a conical expansion surface 30 to allow for the expansion of air in the region behind the hole 28 in the nib 24. In an alternative embodiment, the guide 22 does not have a conical expansion surface and has a constant inner diameter along its entire length. Various adjustments and/or modifications may be made by those of skill in the art in order to optimize the air brush effect based on the materials used and the nature of the particular type of ink used.

In operation, a user depresses or squeezes the pump 12 while holding the nib in proximity to a surface (not shown). The compression of air in the pump 12 causes air to pass through the tube 18, through the guide 22, and out of the nib 24 through the hole 28. As the air passes out of the hole 28, droplets of ink are picked up from the nib 24 and deposited onto the surface, thereby creating an air brush effect. The guide 22 may either be porous or nonporous; if the guide 22 is porous, the guide may itself be saturated with ink such that additional surface area from which ink droplets may be picked up is provided, which may prove beneficial depending upon the materials and preferences.

The air brush marker 10 in accordance with the present invention may be used in conjunction with stencils on a surface. For example, lettering stencils may be used to allow the ink to form letters on a surface, or outlines of letters on a surface, depending on the type of stencils used. Stencils in the form of designs may also be used.

In accordance with another embodiment of the invention, an air brush marker 100 is provided as shown in FIGS. 4-11. The marker 100 is similar to the marker 10 shown in FIGS. 1-3 in that a similar pump 12, plug 14, filter 16, and tube 18 may be used. The marker 100 differs from marker 10 with respect to the nib element, the diffuser, and various other elements associated with the marking portion of the marker 100, as will be described below. Unless otherwise stated, one of skill in the art will appreciate that the marker 100 operates substantially similar to, or with minor modifications to, the marker 10.

Figure 4:
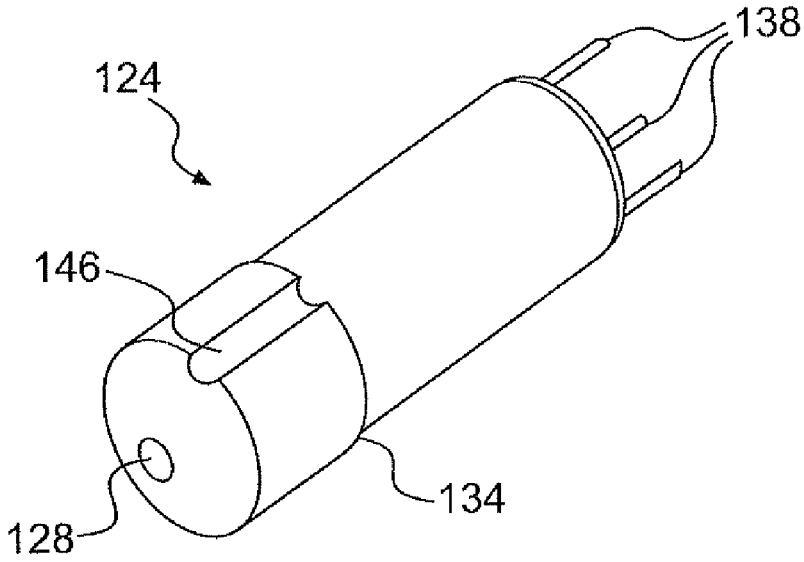
FIG. 4 is a schematic perspective view of a nib for an air brush marker in accordance with an embodiment of the present invention.
Figure 5:
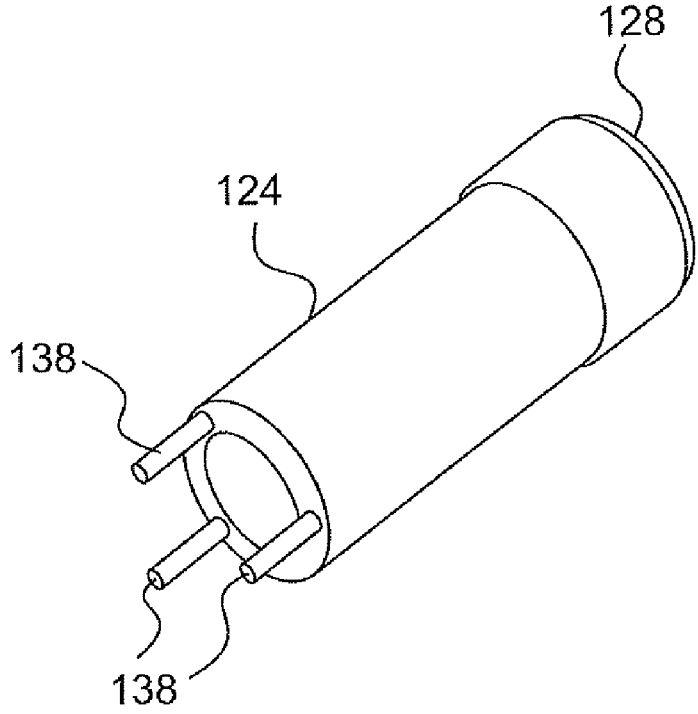
FIG. 5 is a rear schematic perspective view of a nib for an air brush marker in accordance with an embodiment of the present invention.
Figure 6:
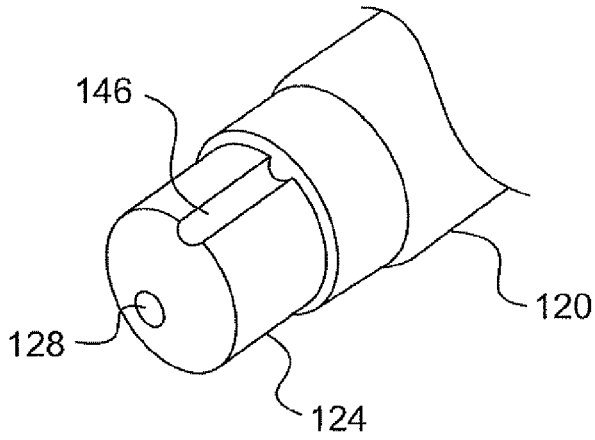
FIG. 6 is a schematic partial perspective view of an air brush marker in accordance with a further embodiment of the present invention.

The nib 124 in accordance with this embodiment of the invention is shown in isolated views in FIGS. 4 and 5. The nib 124 may be formed of absorbent 40-density molded polyethylene and has an opening 128 at a writing, or forward end thereof. The forward end has a diameter that is slightly larger than the diameter of a rearward end. The diameter of the forward end could be, for example, about 10.4 mm and the rearward portion could have a diameter of about 9.3 mm. The opening 128 may have a diameter in the range of about 0.5 mm to about 2.5 mm, and in one implementation is about 1.8 mm in diameter. A venting channel 146 may be provided on the forward portion in order to allow the transfer of air between the inside of the barrel 120 and the outside environment when, for example, the nib is inserted into the barrel 120. As shown in FIG. 6, the nib 124 may be inserted into the barrel 120 so that the forward portion protrudes from the end of the barrel 120 with the venting channel 146 allowing fluid communication between the outside and the inside of the barrel 120. The nib 124 may be about 25 mm in length (not including feeders 138, discussed below). The nib 124 has a hollow interior with an inner diameter of, for example, about 5 mm.

The nib 124 may further be provided with a plurality of feeders 138 extending from and integral therewith. When the nib 124 is inserted into the barrel 120, the feeders 138 are configured to be embedded in the filter 116 to allow for the transfer of ink from the filter 116 to the absorbent nib 124. In this manner, it is not necessary to specially form the filter 116 to accommodate the nib 124 in the filter 116 (as may be desirable in some cases with the nib 24 in FIGS. 1-3), since the feeders 138 can simply push into the filter 116. Any number of feeders 138 may be provided to accommodate the particular ink transfer needs. The feeders 138 may be about 3.7 mm in length and have a diameter of about 1.9 mm.

Figure 7:
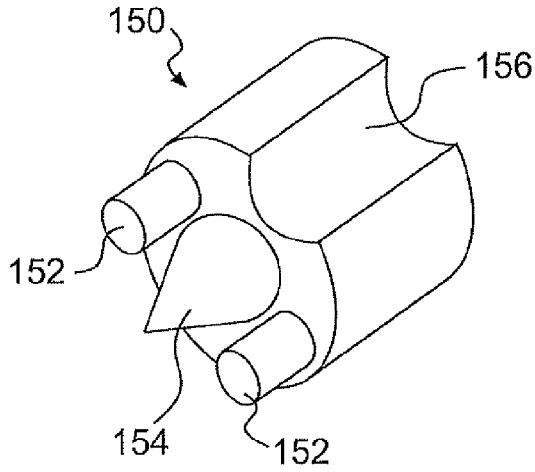
FIG. 7 is a schematic perspective view of a secondary diffuser for an air brush marker in accordance with an embodiment of the present invention.
Figure 8:
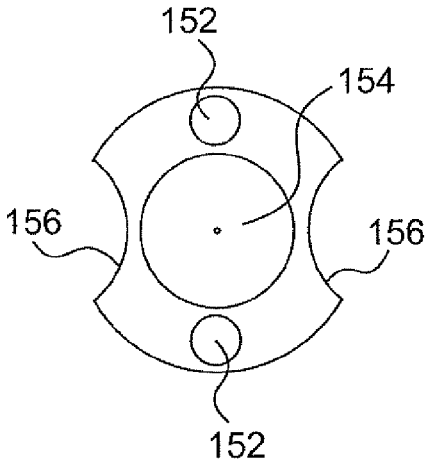
FIG. 8 is a schematic plan view of a secondary diffuser for an air brush marker in accordance with an embodiment of the present invention.

Isolated views of a secondary diffuser 150 are shown in FIGS. 7 and 8. As shown, the secondary diffuser is generally cylindrical and has protruding from its forward end face a conical member 154 and two abutment posts 152. The secondary diffuser may be formed of the same absorbent material that is used to form the nib 124, such as 40-density molded polyethylene. Along the length of the secondary diffuser 150 are two channels 156. The secondary diffuser 150 may have a diameter of about 5.4 mm (taken away from channels 156) and be about 7.0 mm in length (from its rearward end face to the tip of the conical member 154). The conical member 154 itself may have a length of about 3.6 mm and the posts may have a length of about 2 mm. The channels 156 may have a depth of about 1.5 mm.

Figure 9:
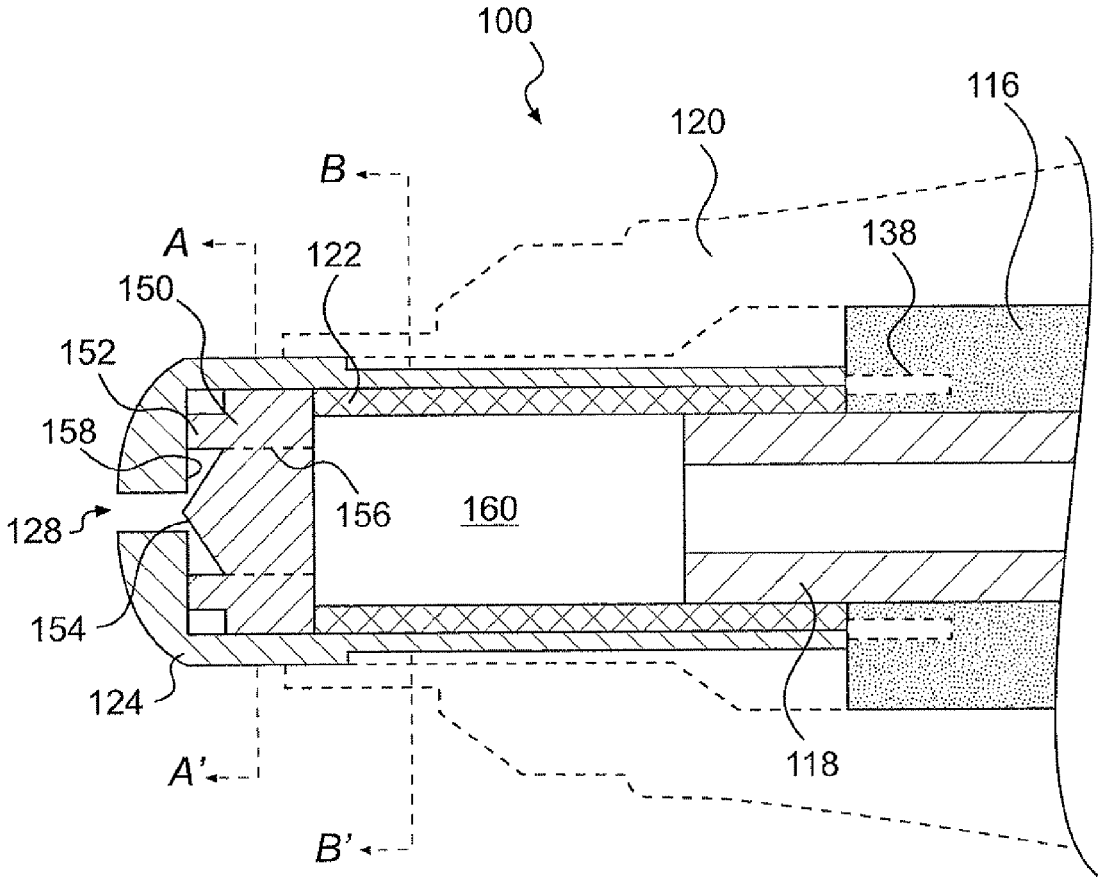
FIG. 9 is a schematic partial cross-sectional view of an air brush marker in accordance with an embodiment of the present invention.

FIG. 9 shows the marker 100 with the nib 124 and the secondary diffuser 150 inserted into the barrel 120 (shown in dashed lines). As shown, the secondary diffuser 150 sits within the interior cavity of the nib 124 with the abutment posts 152 against the interior face 158 of the nib 124. The tip of the conical member 154 is configured to extend to a predetermined position with respect to face 158, either stopping short of face 158, just reaching face 158, or extending beyond face 158 into opening 128. For example, as shown, the tip of the conical member 154 can extend to a predetermined distance into the opening 128 (i.e., beyond the plane of the face 158). As shown, feeders 138 (shown in dashed lines) project into the filter 116 in order to supply ink to the remainder of the nib 124 by capillary action. One of skill in the art will appreciate that the nib 124 and the secondary diffuser 150 may optionally be formed as an integral part.

Figure 10:
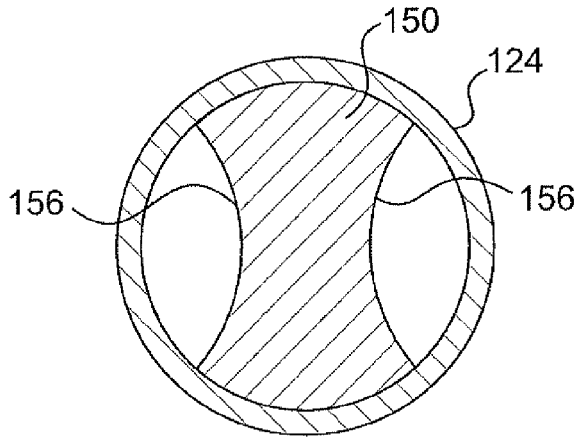
FIG. 10 is a schematic cross-sectional view of an air brush marker taken along line A-A' of FIG. 9 in accordance with an embodiment of the present invention.
Figure 11:
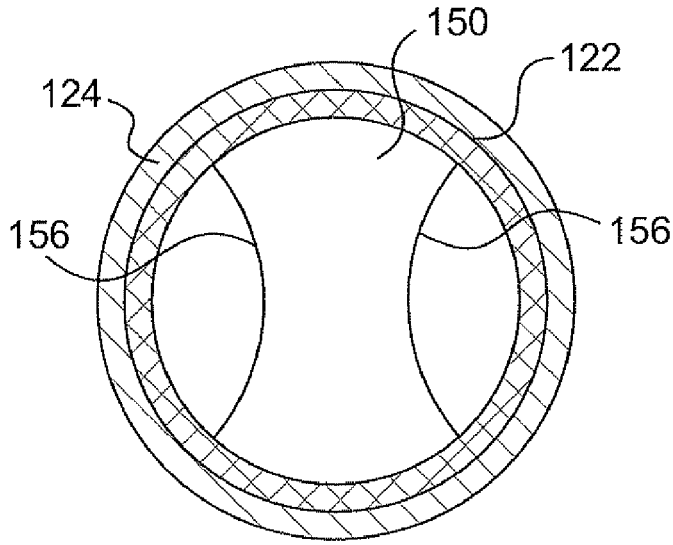
FIG. 11 is a schematic cross-sectional view of an air brush marker taken along line B-B' of FIG. 9 in accordance with an embodiment of the present invention.

A primary diffuser or tube guide 122 can also be provided within the interior cavity of the nib 124. A purpose of the guide 122 is to stabilize and centralize the tube 118, which tube 118 provides the source of pressurized air from the pump 12. Once the air passes through the tube 118, it passes through the space 160 and then passes through the channels 156 (shown in dashed lines in FIG. 9) of the secondary diffuser 150. FIG. 10 is a cross-section of FIG. 9 taken along line A-A', and depicts the location of the channels 156. As shown in FIG. 11, which is a cross-section of FIG. 9 taken along line B-B', it is preferable in this embodiment for the guide 122 to be sufficiently thin so as not to entirely block the channels 156, thus allowing the passage of air past the secondary diffuser. Once the air passes through the channels 156, it exits the marker 100 from the opening 128 in the nib 124. During its passage through space 160, channels 156, and opening 128, the air removes droplets of ink from the surfaces of the diffuser 122, the secondary diffuser 150, and/or the nib 124 so that, when the air mixed with ink droplets exits the opening 128, a spray of fine ink droplets is ejected and may be deposited onto a surface, thus achieving an air brush effect.

A suitable ink that may be used in any of the disclosed embodiments is called "washable classic ink," manufactured by MEGA Brands America. In some embodiments, it may be desirable to add an anti-foaming agent to the ink in order to achieve a clean and consistent spray.

Figure 12:
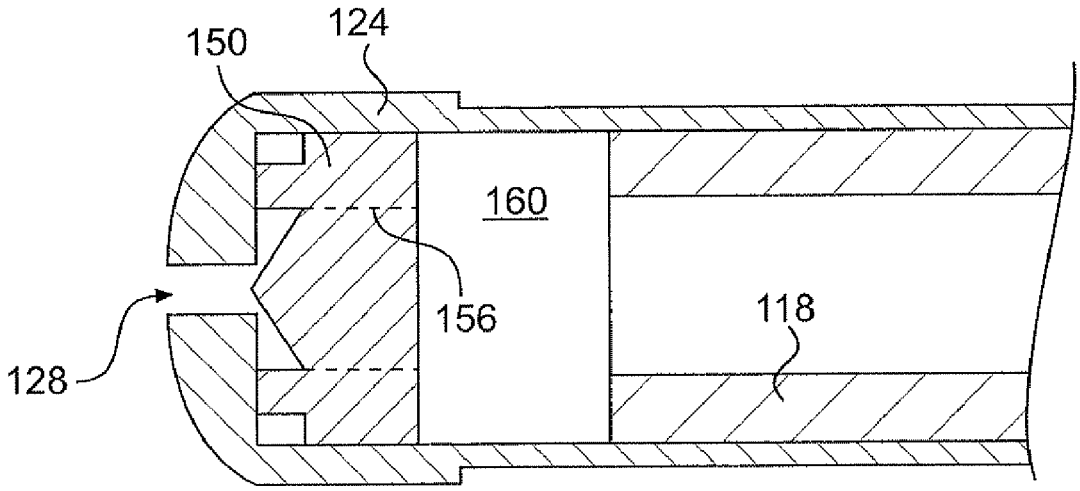
FIG. 12 is a schematic partial cross-sectional view of a nib assembly in accordance with an embodiment of the present invention.

FIG. 12 shows an alternative embodiment of the present invention in which the guide 122 is omitted and the tube 118 is received directly by the nib 124. In this embodiment, the operation is the same as in the embodiment of FIG. 9 except that the tube 118 must be sized accordingly to avoid air loss in the interface between the tube 118 and the nib 124. Although it is shown that the end of the tube 118 is spaced from the secondary diffuser 150, it will be appreciated that, provided that the tube wall is sufficiently thin so as not to completely block the channels 156, the tube may extend into engagement with the secondary diffuser 150.

Figure 13:
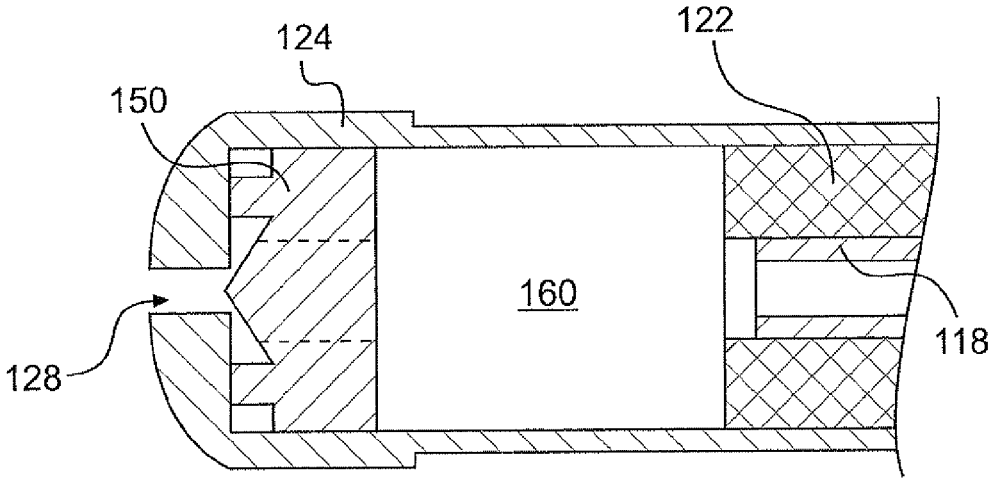
FIG. 13 is a schematic partial cross-sectional view of a nib assembly in accordance with a further embodiment of the present invention.
Figure 14:
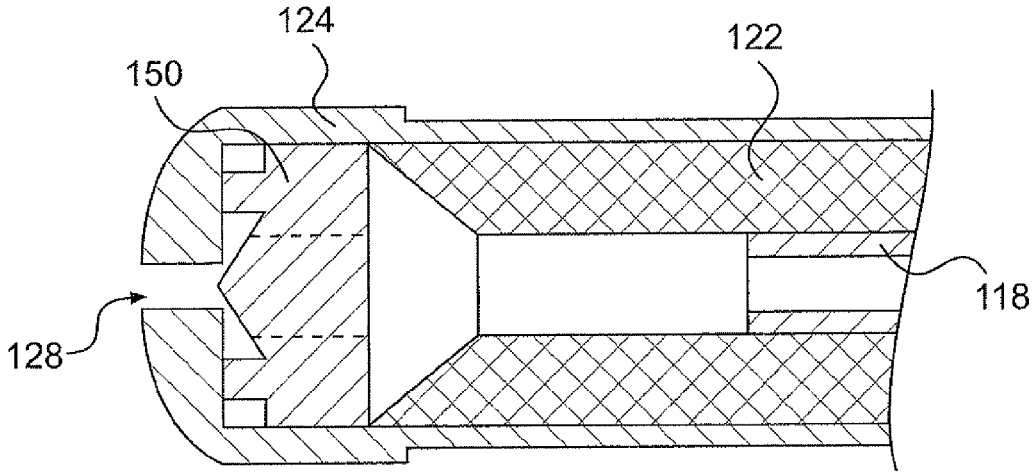
FIG. 14 is a schematic partial cross-sectional view of a nib assembly and tapered guide in accordance with a further embodiment of the present invention.
Figure 15:
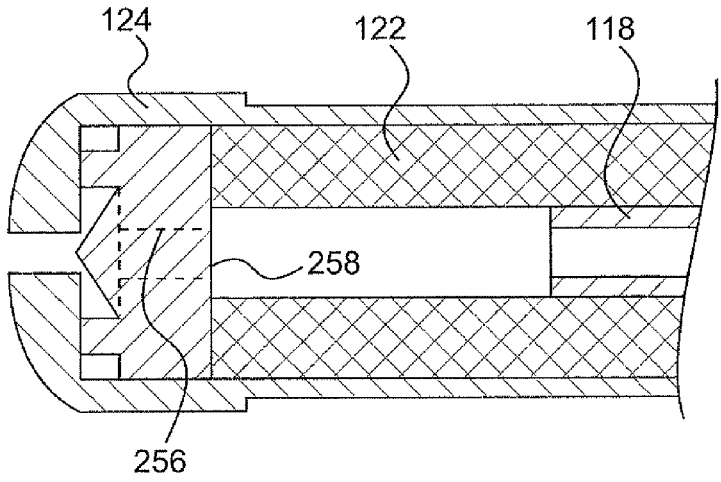
FIG. 15 is a schematic partial cross-sectional view of a nib assembly and thick guide in accordance with an embodiment of the present invention.
Figure 16:
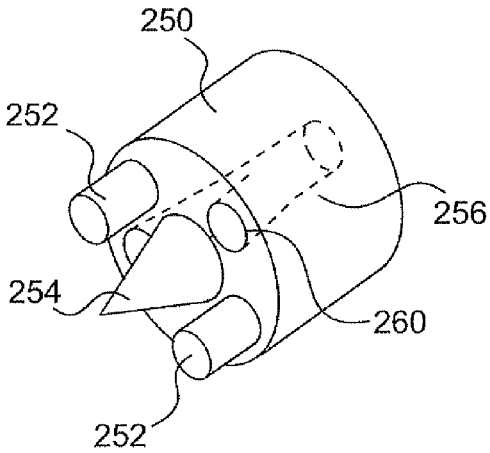
FIG. 16 is a schematic perspective view of a secondary diffuser in accordance with a further embodiment of the present invention.
Figure 17:
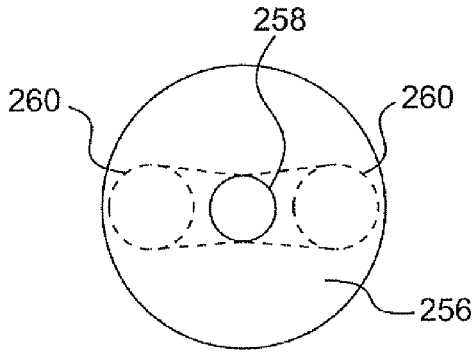
FIG. 17 is a schematic plan view of a secondary diffuser in accordance with a further embodiment of the present invention.

FIGS. 13-15 show several embodiments of the present invention that vary with respect to the construction of the guide 122.

In FIG. 13, the guide 122 has a short length and is provided at the rearward end of the nib 124. As before, the guide 122 receives and centralizes the tube 118 within the nib 124. It will be appreciated by one skilled in the art that the guide 122 may be of any suitable length and that the tube 118 may extend any appropriate distance within the nib 124 as is desired.

In FIG. 14, the guide 122 has a generally large thickness throughout most of its length (to accommodate for example, a thin tube 118) and directly engages the secondary diffuser 150. So as not to block the channels 156, the forward end of the guide 122 is tapered outwardly to allow air to pass through the guide 122 and into the channels 156 of the secondary diffuser.

In FIG. 15, the guide 122 has a large thickness throughout its entire length and could, if used with secondary diffuser 150, entirely block the channels 156. Accordingly, to accommodate the thick guide 122, an alternative secondary diffuser 250 is provided. The secondary diffuser 250 operates in a manner similar to the secondary diffuser 150, except that the air passages 256 are within the body of the diffuser 250. That is, air passages 256 have a first opening 258 at a rearward face of the diffuser 250 to receive incoming air, and one or more second openings 260 (in this case, two second openings) at a forward face of the diffuser 250. In this manner, air passes through the secondary diffuser 250, rather than around it (as in secondary diffuser 150), before passing through the opening 128.

Figure 18:
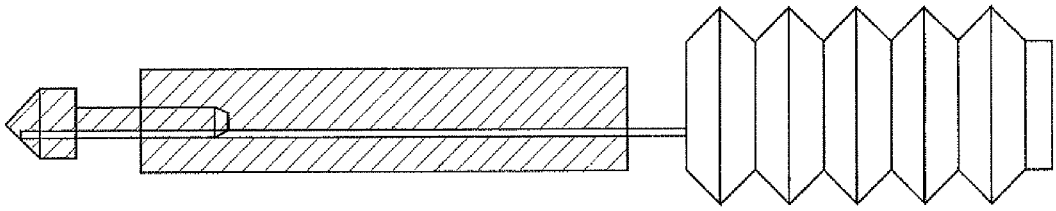
FIG. 18 is a schematic cross-sectional view of an air brush marker in accordance with another embodiment of the present invention.

FIG. 18 illustrates an air brush marker in accordance with another embodiment of the present invention, which comprises a bellows air pump, a nib, an ink filter disposed between the pump and filter, and a tube connected to the pump and extending through the filter and nib. The pump pressurizes air that is then forced through the tube and blown inside the nib, making ink spray out of the nib. To enable the spray of ink, the nib can be porous or define a hole in its front or side.

Figure 19A:
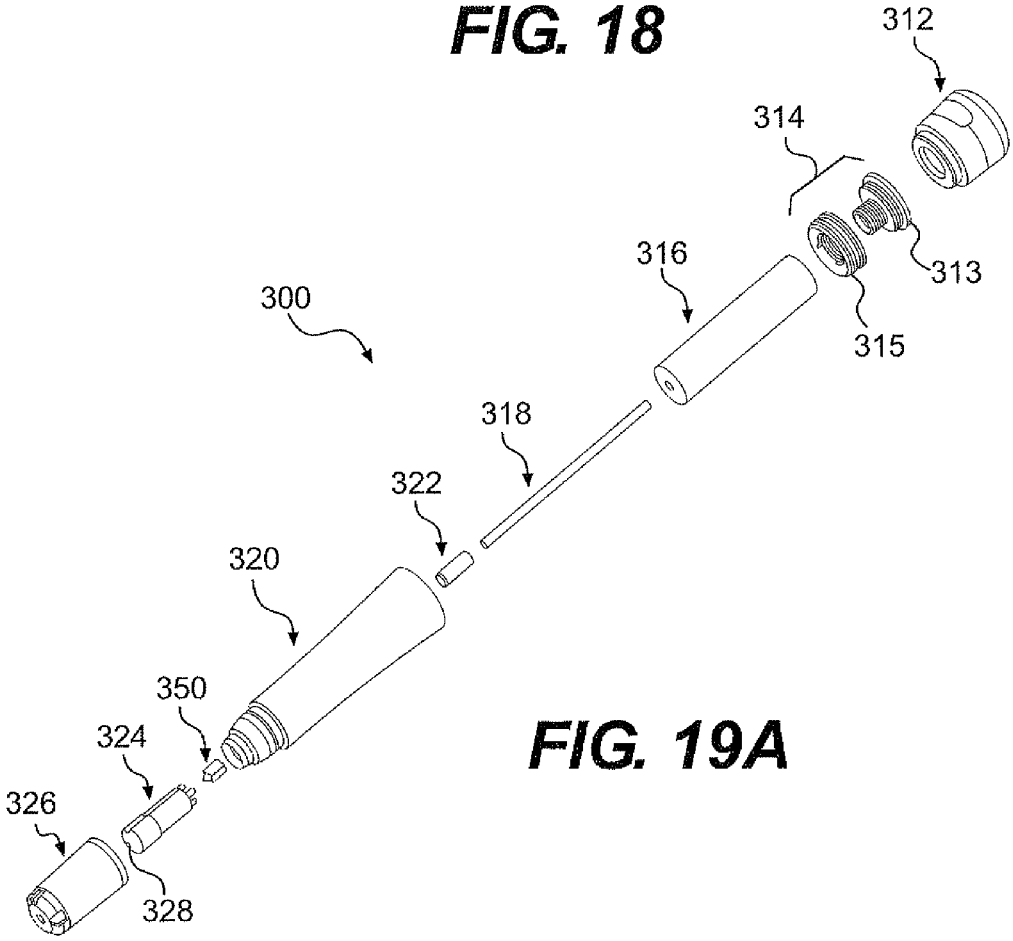
FIG. 19A is a schematic exploded-view diagram of an air brush marker in accordance with another embodiment of the present invention.
Figure 19B:
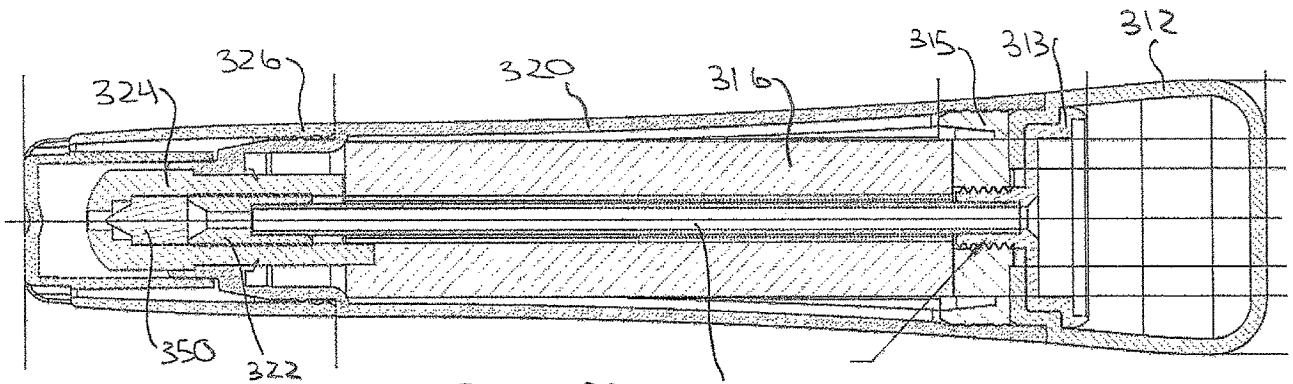
FIG. 19B is a schematic cross-sectional diagram of an air brush marker in accordance with the embodiment of the present invention shown in FIG. 19A.

FIGS. 19A-B illustrate another embodiment of an air brush marker 300 in accordance with the present invention. The marker 300 is similar to the marker 100 (FIG. 9) in operation and structure except as described below. The primary differences between the marker 100 and the marker 300 are the structure of the nib 324, the secondary diffuser 350, and the pump plug 314. These elements are described in further detail below. Unless otherwise provided, one of skill in the art will appreciate that the marker 300 may be made and used in a manner similar to that of marker 100 and that any elements described with respect to a particular embodiment may be combined or substituted with elements described with respect to another embodiment.

As shown in the exploded view of the marker 300 in FIG. 19A and the cross-sectional view of the marker 300 in FIG. 19B, the marker 300 includes a pump 312, a plug 314, a filter 316, a tube 318, a diffuser 322, a barrel 320, a secondary diffuser 350, a nib 324, and a cap 326. The marker 300 is used in substantially the same way as marker 100, in that the filter 316 is saturated with ink, which allows a push on the pump 312 to pass air through the tube 318, through the diffusers 322, 350, and through the nib 324 to eject an ink spray onto a surface to achieve an air brush effect. The marker 300 may also be used as a traditional marker by pressing the nib 324 directly against a surface, thereby marking the surface.

Figure 19D:
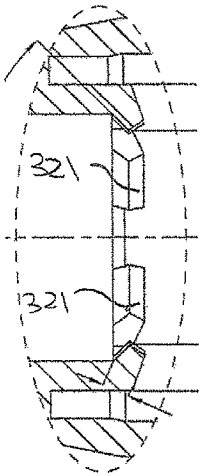
FIGS. 19C-19D are schematic cross-sectional diagrams of a marker barrel in accordance with an embodiment of the present invention.
Figure 19C:
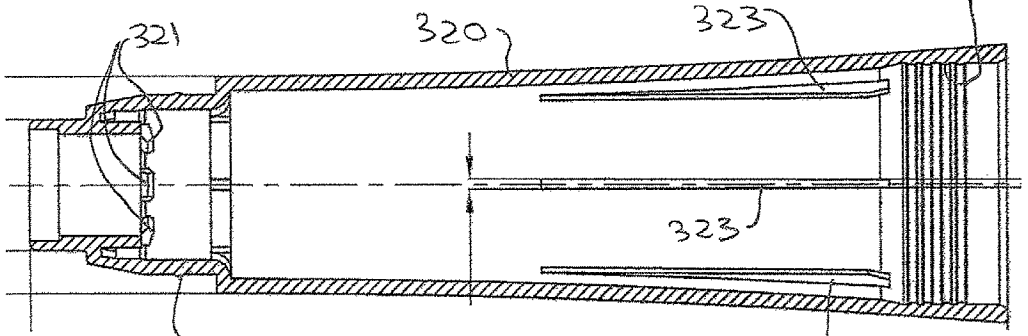

FIGS. 19C-D illustrate a barrel 320 that may be utilized with the air brush marker 300 in accordance with the present invention. The barrel 320 may include body ribs 323 disposed on an interior wall of the barrel 320 and extending longitudinally therein. In this manner, the body ribs 323 are configured to centrally and stably locate the filter 316.

Barrel 320 also includes prongs 321 disposed proximal to the tip of the barrel 320. FIG. 19D is a detail view of the prongs 321. As shown, the prongs 321 are disposed at equal distances around the circumference of an interior wall of the barrel 320. The prongs 321 may alternatively be disposed unequally around the circumference of the interior wall. Further, the number of prongs 321 used may be as little as one or as many as space will allow, or no prongs 321 may be used. The prongs 321 function to dig into a surface of the nib 324, as shown in the cross-sectional view of FIG. 19B, so that the nib is held securely within the barrel 320. The prongs 321 may be angled toward the rear (pump side) of the barrel 320 so that they act to resist a movement of the nib 324 out of the tip of the barrel 320 by digging in.

Figure 19E:
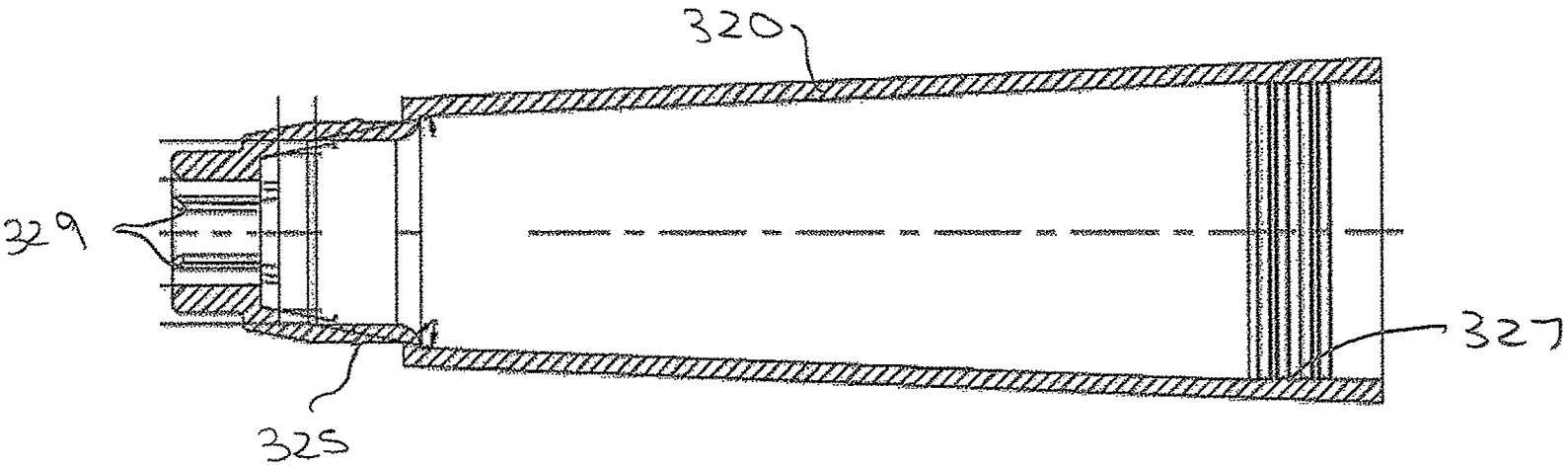
FIG. 19E is a schematic cross-sectional diagram of a marker barrel in accordance with another embodiment of the present invention.

FIG. 19E illustrates a barrel 320 having tip ribs 329. The tip ribs 329 are configured to further locate and stably position the nib 324 in the tip of the barrel 320. One of skill in the art will appreciate that the body ribs 323, the prongs 321, and the tip ribs 329 may all be used together in one embodiment or any combination of one or more of the body ribs 323, the prongs 321, and the tip ribs 329 may be included in any embodiment. The barrel 320 may further be provided with a raised annular protrusion 325 on an outer surface thereof that is configured to engage with ridges provided in a cap 326. In this manner, the cap 326 may be secured to the barrel 320 by means of, for example, a snap fit.

Figure 20E:
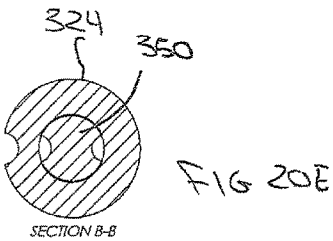
FIGS. 20A-20F are schematic diagrams of a nib assembly in accordance with an embodiment of the present invention.
Figure 20F:
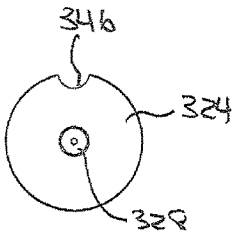
Figure 20B:
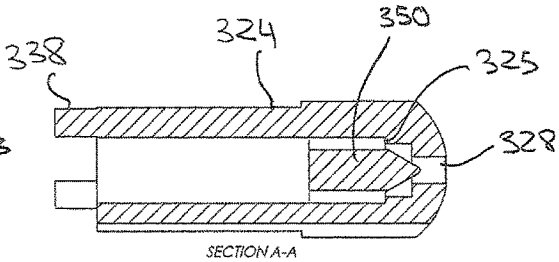
Figure 20A:
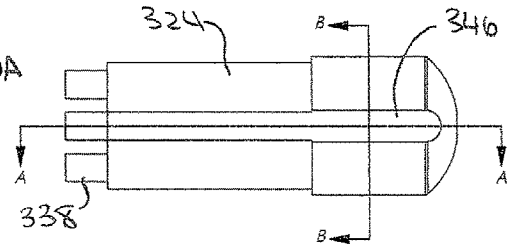
Figure 20C:
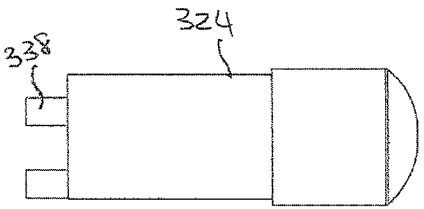
Figure 20D:
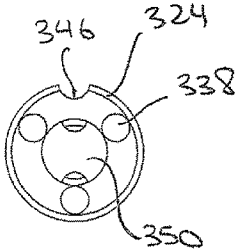
Figure 21A:
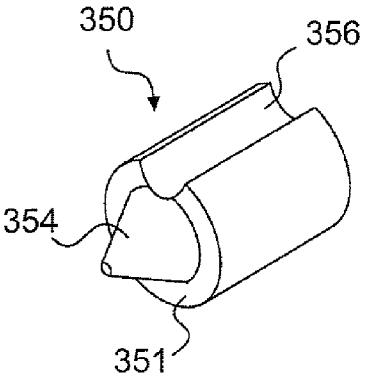
FIGS. 21A-21D are schematic diagrams of a secondary diffuser in accordance with an embodiment of the present invention.
Figure 21B:
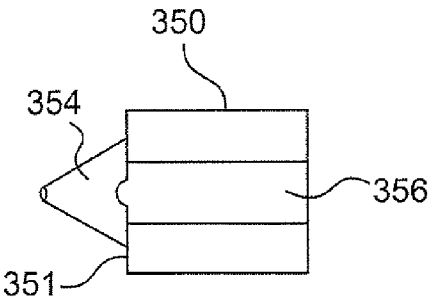
Figure 21C:
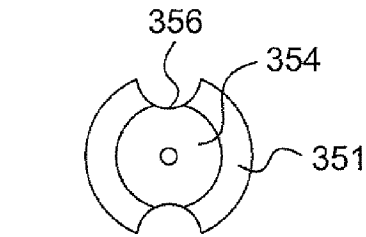
Figure 21D:
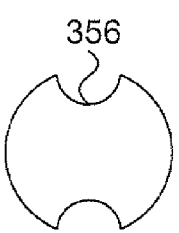

FIGS. 20A-F and 21A-D illustrate a nib 324 and secondary diffuser 350 in accordance with an embodiment of the present invention. As shown in FIG. 20A, the outer structure of the nib 324 is similar to that of nib 124, and similarly includes a venting channel 346 to allow the passage of air during, for example, installation into the barrel 320. The nib 324 may also include feeders 338 which may be inserted into a filter 316 to promote the filling of the nib 324 with ink from the filter 316.

The interior structure of the nib 324, however, differs from that of the nib 124 in that an annular abutment shoulder 325 is provided. The shoulder 325 may be configured to abut a surface 351 of the secondary diffuser 350 (see FIGS. 21A-21D) and to thereby position the conical surface 354 at a predetermined location with respect to the opening 328 in the nib 324. The secondary diffuser 350 is formed substantially similarly to the secondary diffuser 250 except that it does not include abutment posts 152. The spacing function of the posts 152 is instead performed by the abutment shoulder 325 of the nib 324.

As is further shown in FIGS. 21A-21D, the secondary diffuser 350 includes air passages 356 to allow the passage of air when the pump 312 is pushed, in a manner similar to that described above with respect to the air passages 256 in secondary diffuser 250.

The inter-relationship between the structure of the nib 324 and the conical surface 354 of the secondary diffuser 350 produces surprising and unexpected results with respect to the resulting dispensing of ink upon a surface. By configuring the structures in the manner described herein, advantageous aerodynamic effects may be realized in order to achieve a clean, evenly dispersed spray pattern that has not been realized by the prior art.

The air passages 356 provide a useful role in achieving desired effects by supplying air to the nib opening 328, which is generally in a central location, from a generally outer location to enhance the spray pattern. In other words, after passing through the passages 356, which are at an outer location with respect to the secondary diffuser 350, the air converges in the nozzle-like region formed by the conical surface 354 and the nib opening 328. This structure helps provide advantageous pressure and velocity characteristics for capturing ink particles from the absorbent structures, such as the nib 324 and the secondary diffuser 350 itself, and for subsequently depositing the ink particles onto a surface in a generally dispersed pattern.

Although the passages 356 are generally shown in extending parallel to a longitudinal axis of the secondary diffuser 350, the secondary diffuser may instead be provided with air passages that are angled or otherwise asymmetrical in a manner that induces a rotational velocity to air that passes through the passages of the secondary diffuser. Accordingly, a swirling airflow induced in this manner in the space formed by the conical surface 354 of the secondary diffuser 350 and the interior of the nib 324 may have further advantageous and unexpected results.

FIGS. 22A-22C illustrate the marker 300 excluding the barrel 320 and the filter 316 for clarity. As shown, the tube 318 is inserted into a hole 332 in the plug 314, which is in fluid communication with the inside of the pump 312. At the other end of the assembly, the tube is held in place by the diffuser 322, which is in turn fitted into the nib 324. The secondary diffuser 350 is in place in the nib 324 and held against the shoulder 325. As the pump 312 is compressed, for example by a user's thumb or palm, air inside the chamber of the pump 312 is compressed and caused to flow through the tube 318 and out the opening 328. Along the way, the air passes through the diffuser 322, the secondary diffuser 350, and the nib 350, one or more of which may contain ink so that the air picks up ink particles and deposits them on a surface outside of the opening 328.

FIGS. 23A-23F illustrate the pump 312 and plug 314 in greater detail. As best seen in the cross-sectional view of FIGS. 23C, 23E, and 23F, the pump 312 has a generally bulbous cup shape with an opening. A stepped annular rim 317 is provided around the opening of the pump 312 for use in attaching the plug 314.

With reference to FIGS. 24A-B and 25A-D, the plug 314 generally includes two parts, an inner member 313 and an outer member 315. The inner member 313 has a stepped portion 305 that corresponds to the stepped rim 317 of the pump 312. The inner member 313 further includes an attachment region 319, which is shown as threaded in FIGS. 23C and 24A-B but may also be snap-fit connection or the like.

Figure 23A:
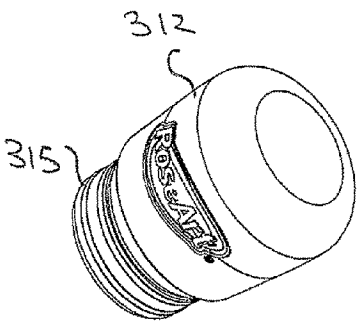
FIGS. 23A-23F are schematic diagrams of a pump assembly and pump in accordance with an embodiment of the present invention.
Figure 23B:
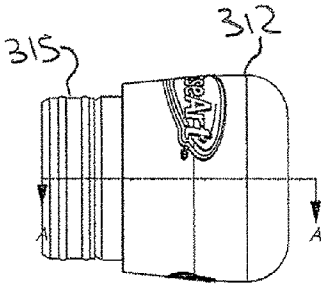
Figure 23C:
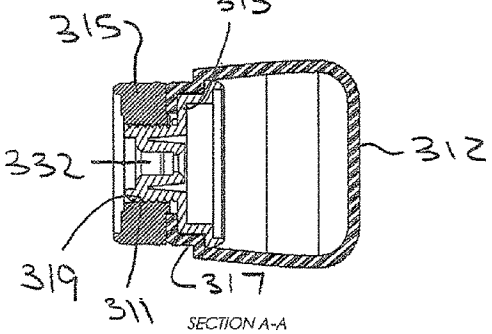
Figure 23D:
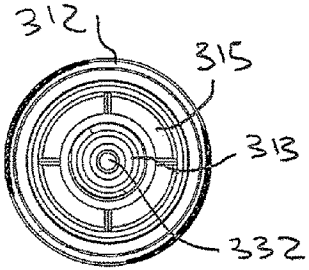
Figure 23F:
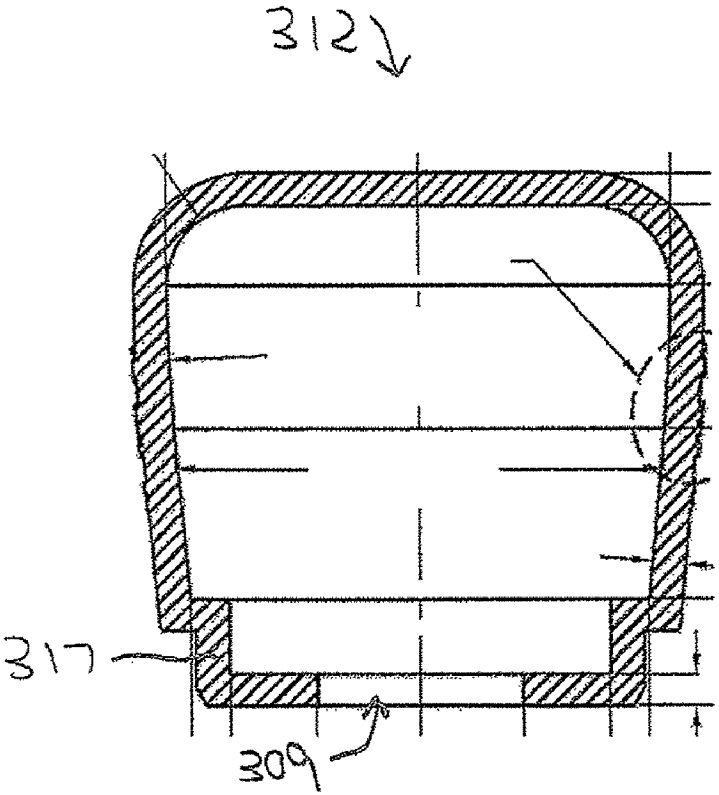
Figure 23E:
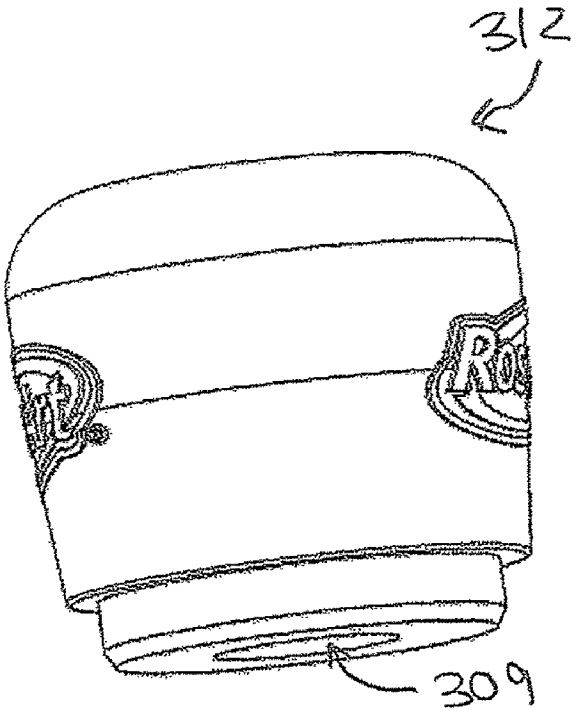
Figure 24B:
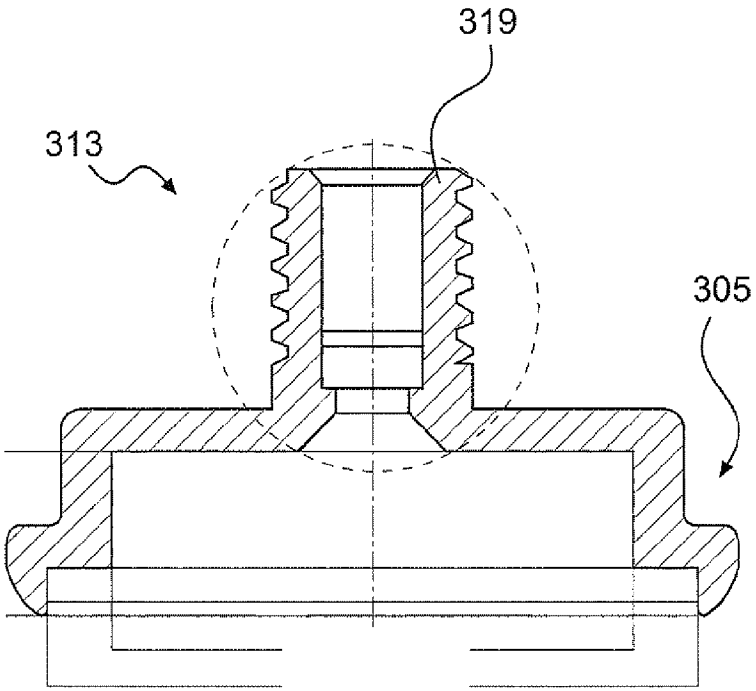
FIGS. 24A-24B are schematic diagrams of an inner plug member in accordance with an embodiment of the present invention.
Figure 24A:
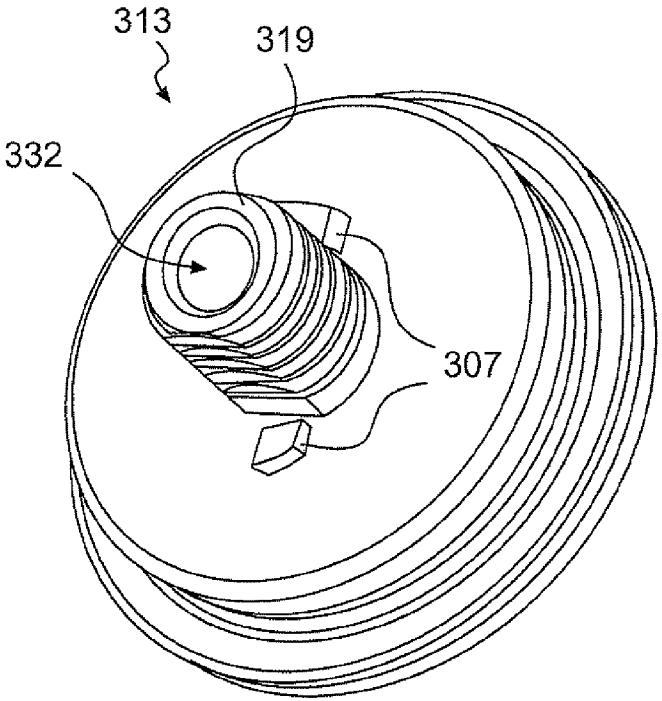
Figure 25B:
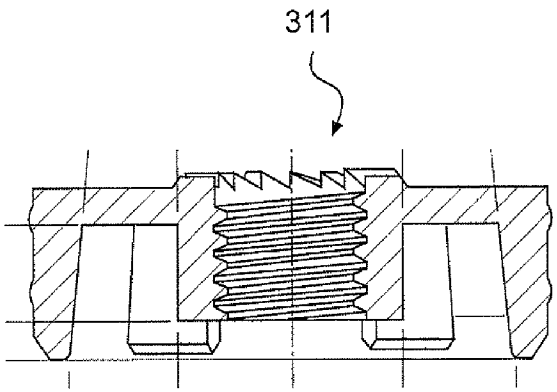
FIGS. 25A-25D are schematic diagrams of an outer plug member in accordance with an embodiment of the present invention.
Figure 25D:
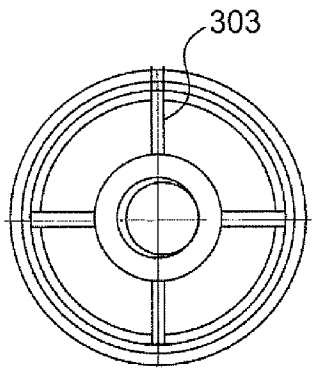
Figure 25A:
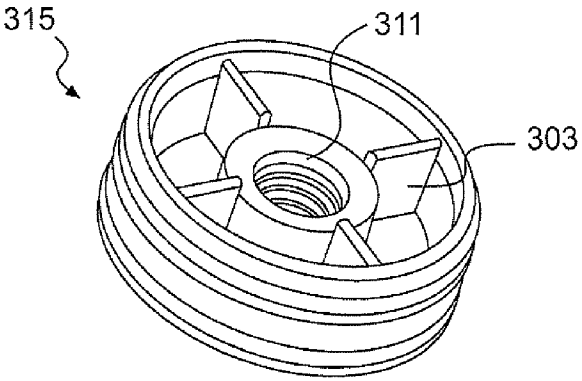
Figure 25C:
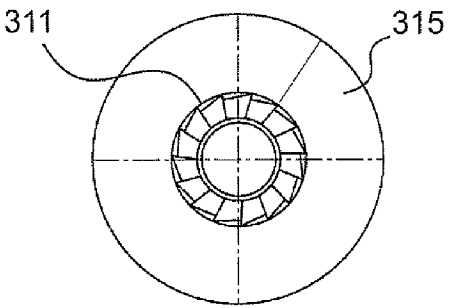

The outer member 315 has a corresponding attachment region 311 for attaching to the attachment region 319 of the inner member 313. As shown in FIGS. 23C and 25A-B, the attachment region 311 is threaded, although other types of attachment fittings may be used such as, for example, a snap-fit. The inner member 313 and the outer member 315 attach to the pump 312 so as to sandwich a portion of the rim 317 of the pump 312 between a portion of the inner member 313 and a portion of the outer member 315, creating a tight and sealed connection preferably avoiding the leakage of air. The hole 332 is provided in the inner member 313 to accommodate the tube 318 and thereby permit the passage of air through the assembled marker 300 and out through the opening 328. The outer member 315 may include reinforcement ribs 303 to add strength to the structure.

Figure 26B:
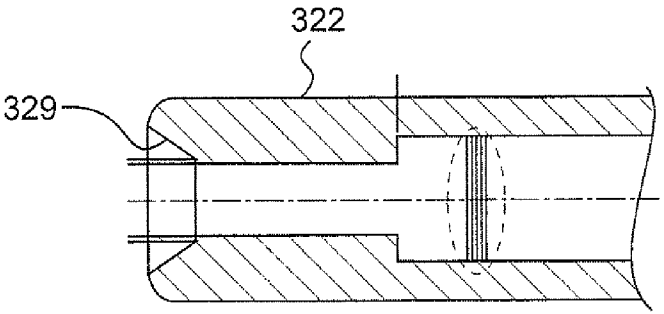
FIGS. 26A-26C are schematic diagrams of a diffuser in accordance with an embodiment of the present invention.
Figure 26A:
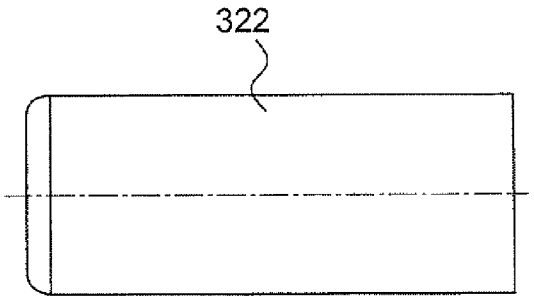
Figure 26C:
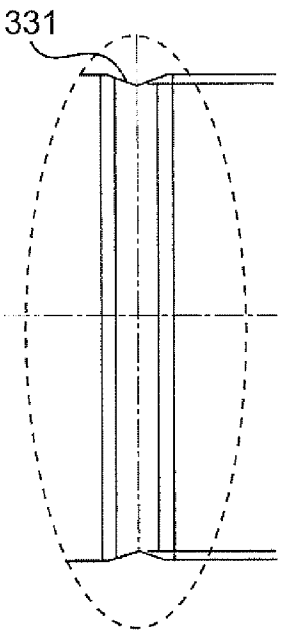

FIGS. 26A-C illustrate a diffuser 322 in accordance with an embodiment of the present invention. In the example shown, the diffuser 322 is generally cylindrical and includes a conical surface 329 at an end of the diffuser 322 that is closest to the tip of the marker 300. Behind the conical surface 329, the diffuser 322 may have two sections with differing diameters, as shown, to optimize the flow of air through the diffuser 322 to promote an effective blast of ink. In some embodiments (such as that shown in FIG. 19B), the difference in diameter between the sections of the diffuser 322 is approximately equal that the thickness of the walls of the tube 318. In this manner, there is no immediate change in diameter when the air passes from the tube 318 to the diffuser 322. The diffuser 322 may further include an annular protrusion 331 that aids in providing a secure connection, by compression, with the tube 318, as can be seen in, for example, FIG. 19B.

The interior conical surface 329 of the diffuser 322 has unexpected and advantageous results. In connection with the tube 318 and the air passages 356 of the secondary diffuser 350, the shape of the diffuser produces beneficial aerodynamic effects through expansion and contraction such that, for example (and without wishing to be bound to theory), utilize the Venturi effect to create pressure decreases that act to pull ink particles from the liquid-absorbent secondary diffuser 350 and nib 324. These effects may further be utilized in the region of the air passage defined by the conical surface 354 of the secondary diffuser 350 and the interior of the tip portion of the nib 324. By pulling ink particles from absorbent materials in this manner, a well-combined air and ink mixture is created and dispensed out of the nib opening 328 to produce a clean, evenly dispersed pattern that is generally widely spread and not too concentrated, such as the ink pattern 400 shown in FIG. 29C.

Although embodiments described above include a manual pump to provide pressurized air, one of ordinary skill in the art would appreciate that other mechanisms can be used to pressurize air. For example, an air brush marker of the present invention could incorporate a motorized air pump, a compressed air container, or a mouthpiece through which a user blows air. Thus, notwithstanding the particular benefits associated with a manual pump, the present invention should be considered broadly applicable to any number of means for delivering pressurized air.

Figure 27B:
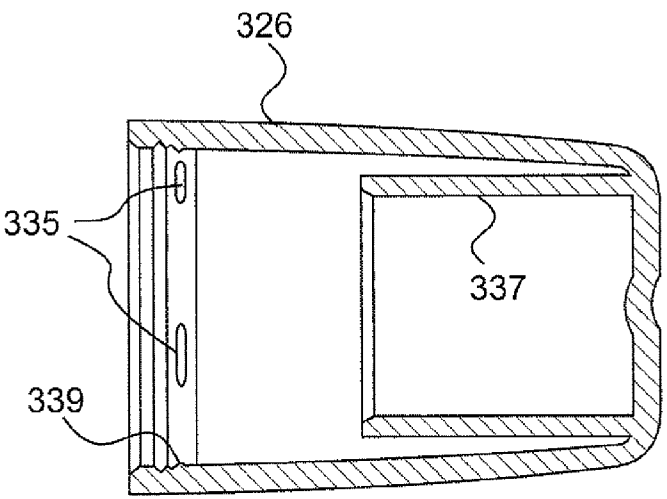
FIGS. 27A-27B are schematic diagrams of a marker cap in accordance with an embodiment of the present invention.
Figure 27A:
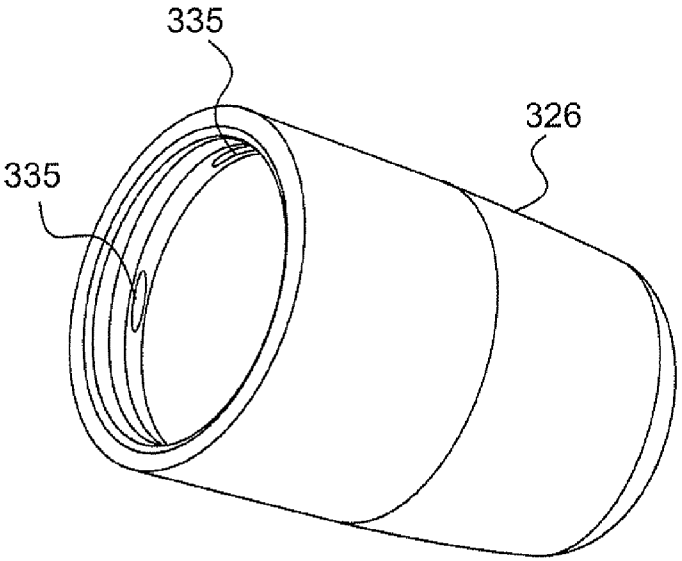
Figure 28B:
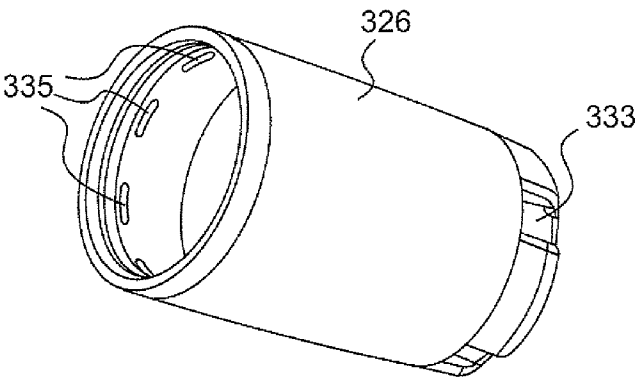
FIGS. 28A-28C are schematic diagrams of a marker cap in accordance with another embodiment of the present invention.
Figure 28C:
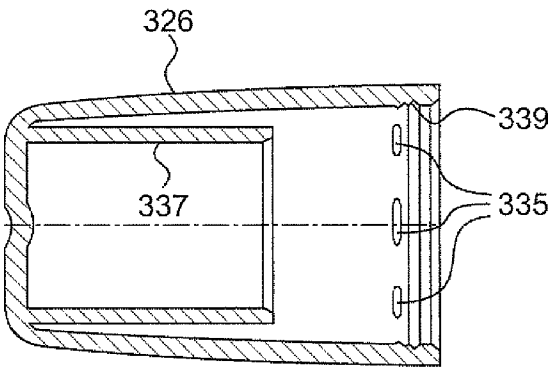
Figure 28A:
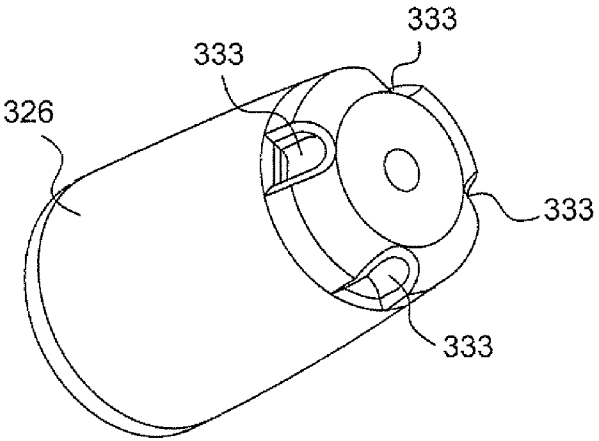

FIGS. 27A-B illustrate a suitable cap 326 for use with the marker 300 of the present invention. The cap 326 may include raised bumps 335 for snapping onto the tip of the marker 300. For example, the raised bumps 335 may be configured to attach the cap 326 to the marker barrel 320 by snapping past the raised annular protrusion 325 on the barrel shown in FIG. 19C. The cap 326 may also include an internal chamber 337 for fitting closely around the tip of the marker 300 and, in turn, the nib 324 to aid in protecting the nib and/or ink leakage and/or drying out. FIGS. 28A-C illustrate the cap 326 having the further feature of vents 333. The vents 333 may be configured to allow the passage of air through the cap when it is attached to the marker barrel 320 so as to avoid pressure buildup that could make securely attaching the cap 326 difficult while retaining the ink-filled nib 324 within the airtight chamber 337 to prevent drying out. Alternatively, vents 333 may be configured to allow ambient air to reach the nib 324 in cases where it is preferable for the ink to be communication with such air.

Figure 29B:
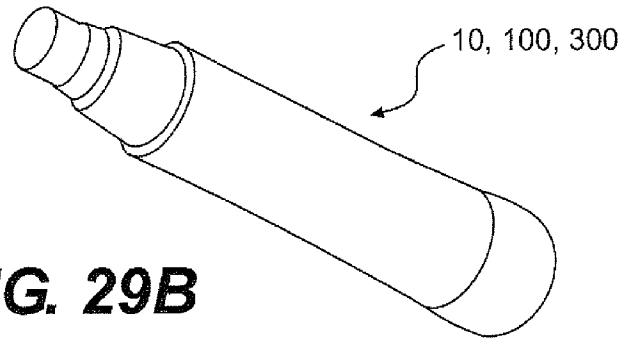
FIGS. 29A-29C are schematic diagrams of an assembled marker in accordance with an embodiment of the present invention.
Figure 29A:
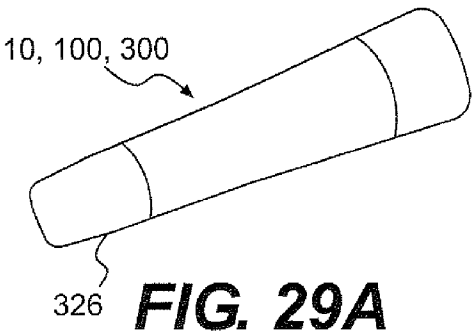
Figure 29C:
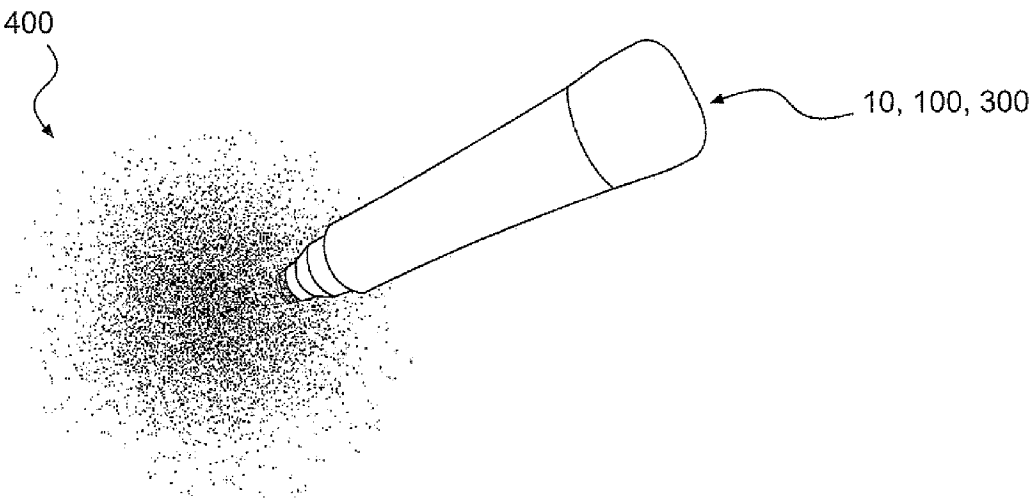

FIGS. 29A-C generally depict a marker in accordance with the present invention, In FIG. 29A, the marker 10, 100, 300 is shown in a stored state with the cap 326 attached. In FIG. 29B, the cap 326 is removed, rendering the marker 10, 100, 300 ready for use. FIG. 29C shows the effect of the marker 10, 100, 300 upon depression of the pump 312. The resultant ink pattern 400 preferably simulates the effect of an air brush.

In addition, components of the present invention could be combined, for example, as with the secondary diffuser and nib described above with reference to FIG. 9. As another example, instead of using a separate tube (e.g., tube 18 or 118), the filter itself could be used to deliver the pressurized air from the pump to the nib. For example, the filter could have an air-impermeable longitudinal channel in which the air could be contained and through which the air could pass.

In other embodiments, the tube may not be necessarily coaxial with or in the radial center of the filter or barrel. For example, the tube may be parallel to and/or offset from the longitudinal axis of the barrel or filter. Alternatively, the tube may be spiral shaped and extend through a generally central region of the filter so as to provide added stability (by resisting motion relative to the filter in an axial direction, for example).

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. An air brush marker comprising:

a marker barrel having a first end and a second end;

a pump disposed at the first end of the marker barrel;

a hollow nib disposed at the second end of the marker barrel, the nib being configured to absorb ink;

a filter disposed within the marker barrel, the filter being configured to absorb ink and being positioned in contact with the nib;

a tube disposed within the marker barrel, the tube providing an air passage extending from the pump to the nib, wherein the pump is configured to supply a burst of air through the tube and the nib such that ink particles are sprayed out of the marker at the second end in a generally dispersed pattern; and a diffuser disposed within the nib, the diffuser being configured to position the tube in a central radial position with respect to the marker barrel.

2. The air brush marker of claim 1, further comprising a secondary diffuser positioned within the nib, the secondary diffuser having a conical surface proximal to an opening in the nib to direct the burst of air out of the marker, the secondary diffuser being located relative to the diffuser such that the burst of air supplied by the pump first passes through the diffuser and then passes through the secondary diffuser.

3. The air brush marker of claim 2, wherein a tip of the conical surface of the secondary diffuser protrudes into the opening in the nib without making contact with the surfaces of the nib that form the opening.

4. The air brush marker of claim 2, wherein the secondary diffuser has one or more abutment posts located thereon that maintain the secondary diffuser at a predetermined position in relation to the opening of the nib.

5. The air brush marker of claim 2, wherein the nib has an annular abutment shoulder on an interior surface thereof that maintains the secondary diffuser at a predetermined position in relation to the opening of the nib.

6. The air brush marker of claim 2, wherein the secondary diffuser comprises at least one channel on an outer surface thereof that permits the burst of air to pass between the secondary diffuser and an interior surface of the nib.

7. The air brush marker of claim 2, wherein the secondary diffuser comprises at least one channel passing through an interior portion of the secondary diffuser such that the burst of air is permitted to pass from the diffuser to an opening in the nib.

8. The air brush marker of claim 1, wherein the diffuser comprises a conical interior surface allowing for expansion of air passing through the diffuser.

9. The air brush marker of claim 1, wherein the marker barrel comprises longitudinally extending ribs on an interior surface of the marker barrel, the ribs being configured to centrally position the filter within the marker barrel.

10. The air brush marker of claim 1, wherein the marker barrel comprises prongs extending inwardly from an interior surface of the marker barrel, the prongs being configured to press against the nib, thereby aiding in retaining the nib in position within the marker barrel.

11. The air brush marker of claim 1, wherein the marker barrel comprises longitudinally extending ribs on an interior surface of a tip portion of the marker barrel, the ribs being configured to aid in positioning the nib within the tip of the marker barrel.

12. The air brush marker of claim 1, wherein the nib comprises one or more feeder posts that extend from the nib in a direction toward the first end of the marker barrel, the feeder posts being inserted into the filter to transfer ink from the filter to the nib.

13. An air brush marker of comprising:

a marker barrel having a first end and a second end;

a pump disposed at the first end of the marker barrel;

a hollow nib disposed at the second end of the marker barrel, the nib being configured to absorb ink;

a filter disposed within the marker barrel, the filter being configured to absorb ink and being positioned in contact with the nib; and a tube disposed within the marker barrel, the tube providing an air passage extending from the pump to the nib, wherein the pump is configured to supply a burst of air through the tube and the nib such that ink particles are sprayed out of the marker at the second end in a generally dispersed pattern, and wherein the nib comprises one or more feeder posts that extend from the nib in a direction toward the first end of the marker barrel, the feeder posts being inserted into the filter to transfer ink from the filter to the nib.

14. The air brush marker of claim 13, further comprising a diffuser disposed within the nib, the diffuser being configured to position the tube in a central radial position with respect to the marker barrel.

15. The air brush marker of claim 14, further comprising a secondary diffuser positioned within the nib, the secondary diffuser having a conical surface proximal to an opening in the nib to direct the burst of air out of the marker, the secondary diffuser being located relative to the diffuser such that the burst of air supplied by the pump first passes through the diffuser and then passes through the secondary diffuser.

16. The air brush marker of claim 15, wherein a tip of the conical surface of the secondary diffuser protrudes into the opening in the nib without making contact with the surfaces of the nib that form the opening.

17. The air brush marker of claim 15, wherein the nib has an annular abutment shoulder on an interior surface thereof that maintains the secondary diffuser at a predetermined position in relation to the opening of the nib.

18. The air brush marker of claim 15, wherein the secondary diffuser comprises at least one channel on an outer surface thereof that permits the burst of air to pass between the secondary diffuser and an interior surface of the nib.

19. The air brush marker of claim 14, wherein the diffuser comprises a conical interior surface allowing for expansion of air passing through the diffuser.

20. The air brush marker of claim 13, wherein the marker barrel comprises longitudinally extending ribs on an interior surface of the marker barrel, the ribs being configured to centrally position the filter within the marker barrel.

* * * * *